US008146477B2

(12) United States Patent
Joynt

(10) Patent No.: US 8,146,477 B2
(45) Date of Patent: Apr. 3, 2012

(54) SYSTEM FOR PROTECTING A VEHICLE FROM A MINE

(75) Inventor: Vernon P. Joynt, Pretoria (ZA)

(73) Assignee: Force Protection Technologies, Inc., Ladson, SC (US)

( * ) Notice: Subject to any disclaimer, the term of this patent is extended or adjusted under 35 U.S.C. 154(b) by 0 days.

(21) Appl. No.: 12/780,532

(22) Filed: May 14, 2010

(65) Prior Publication Data

US 2011/0277621 A1 Nov. 17, 2011

(51) Int. Cl.
*F41H 7/02* (2006.01)

(52) U.S. Cl. ..... 89/36.08; 89/36.09; 296/187.07; 296/187.08

(58) Field of Classification Search ..... 89/36.01, 89/36.07, 36.08, 36.09; 296/187.07, 187.08, 296/193.07; 102/402
See application file for complete search history.

(56) References Cited

U.S. PATENT DOCUMENTS

| | | | | |
|---|---|---|---|---|
| D142,247 | S | 8/1945 | Hill | |
| 2,382,862 | A | 8/1945 | Davis, Jr. | |
| D143,365 | S | 12/1945 | Sutphen | |
| D144,344 | S | 4/1946 | Alexander | |
| D164,216 | S | 8/1951 | Baldine | |
| 3,176,585 | A | 4/1965 | Ruf | |
| 3,720,280 | A | 3/1973 | Eiler | |
| 4,156,536 | A | 5/1979 | Brandstadter | |
| 4,158,986 | A | 6/1979 | Appelblatt et al. | |
| 4,174,653 | A | 11/1979 | Appelblatt | |
| 4,280,393 | A | 7/1981 | Giraud et al. | |
| 4,319,777 | A | 3/1982 | Law | |
| 4,326,445 | A | 4/1982 | Bemiss | |
| 4,492,282 | A | 1/1985 | Appelblatt et al. | |
| 4,607,562 | A | 8/1986 | LeBlanc | |
| 5,370,034 | A | 12/1994 | Turner et al. | |
| 5,749,140 | A | 5/1998 | Polito et al. | |
| 6,173,482 | B1 | 1/2001 | Riddle et al. | |
| 6,254,394 | B1 | 7/2001 | Draper et al. | |
| 6,435,071 | B1 | 8/2002 | Campbell | |
| 6,477,934 | B1 * | 11/2002 | Bruhn et al. | 296/193.07 |
| 7,357,062 | B2 | 4/2008 | Joynt | |
| 7,357,065 | B2 | 4/2008 | Mitsui | |
| 7,510,235 | B2 | 3/2009 | Kobayashi et al. | |
| 7,685,924 | B2 | 3/2010 | Barbe et al. | |
| 7,712,823 | B2 | 5/2010 | Greuter et al. | |

(Continued)

FOREIGN PATENT DOCUMENTS

| | | |
|---|---|---|
| DE | 196 31 715 A1 | 2/1998 |

(Continued)

*Primary Examiner* — Gabriel Klein
(74) *Attorney, Agent, or Firm* — Finnegan Henderson Farabow Garrett & Dunner, LLP

(57) ABSTRACT

In one aspect, the present disclosure is directed to a system for protecting a vehicle from a mine. Upon detonation the mine may yield ejecta having an expected trajectory. The system has a first layer of material disposed outside of an underbody of a hull of the vehicle. The first layer includes a base disposed in a direction substantially parallel to the underbody and a protrusion that narrows as it extends away from the base in a direction opposing the expected ejecta trajectory. The system also has a second layer including a material having a shock wave transmission velocity that is higher than a shock wave transmission velocity of the material of the first layer. The system further has an exterior layer substantially covering the first and second layers, and the exterior layer has an exterior surface that faces away from the underbody and toward the expected ejecta trajectory.

24 Claims, 3 Drawing Sheets

U.S. PATENT DOCUMENTS

| | | | | |
|---|---|---|---|---|
| 7,954,419 | B2 | 6/2011 | Ran et al. | |
| 8,033,208 | B2 | 10/2011 | Joynt et al. | |
| 2003/0010189 | A1* | 1/2003 | Zonak | 89/36.08 |
| 2005/0188831 | A1 | 9/2005 | Squires et al. | |
| 2005/0257679 | A1 | 11/2005 | Hass et al. | |
| 2007/0113730 | A1 | 5/2007 | Benyami et al. | |
| 2007/0180981 | A1 | 8/2007 | Tapp et al. | |
| 2007/0186762 | A1 | 8/2007 | Dehart et al. | |
| 2007/0234896 | A1 | 10/2007 | Joynt | |
| 2008/0034953 | A1* | 2/2008 | Barbe et al. | 89/36.01 |
| 2008/0111396 | A1* | 5/2008 | Barbe et al. | 296/187.08 |
| 2009/0114083 | A1 | 5/2009 | Moore, III et al. | |
| 2009/0140545 | A1* | 6/2009 | Greuter et al. | 296/187.07 |
| 2009/0293712 | A1 | 12/2009 | Ran et al. | |
| 2010/0187864 | A1 | 7/2010 | Tsuchida | |
| 2010/0218667 | A1 | 9/2010 | Naroditsky et al. | |
| 2010/0307327 | A1* | 12/2010 | Gettle | 89/36.02 |
| 2010/0307329 | A1* | 12/2010 | Kaswen et al. | 89/36.08 |
| 2010/0319525 | A1* | 12/2010 | Pavon | 89/36.02 |
| 2011/0148147 | A1 | 6/2011 | Tunis et al. | |

FOREIGN PATENT DOCUMENTS

| | | | |
|---|---|---|---|
| DE | 196 31 715 | C2 | 1/2000 |
| EP | 1 574 812 | A1 | 9/2005 |
| EP | 1 291 610 | B1 | 2/2006 |
| EP | 1 821 061 | A1 | 8/2007 |
| EP | 2 128 558 | A2 | 12/2009 |
| FR | 2 443 964 | | 7/1980 |
| GB | 457 156 | | 11/1936 |
| GB | 2 419 567 | A | 5/2006 |
| JP | 04-136699 | | 5/1992 |
| JP | 06-051095 | | 2/1994 |
| TW | 438694 | B | 6/2001 |
| TW | 468136 | B | 12/2001 |
| WO | WO 02/39048 | A2 | 5/2002 |
| WO | WO 03/102489 | A1 | 12/2003 |
| WO | WO 2004/038320 | A1 | 5/2004 |
| WO | WO 2009/140331 | A1 | 11/2009 |
| WO | WO 2011/022295 | A1 | 2/2011 |

* cited by examiner

SYSTEM FOR PROTECTING A VEHICLE FROM A MINE

DESCRIPTION OF THE INVENTION

1. Field of the Invention

The present disclosure relates to a system for protecting a vehicle from a mine.

2. Background of the Invention

Conventional armored motor vehicles attempt to moderate the effect of mines and explosive devices by using armor of a thickness that will not be penetrated by soil, rocks or the like, or by the blast from such a mine or explosive device. Such vehicles generally have bottom surfaces parallel to the surface on which they ride.

When such vehicles detonate an anti-vehicle mine below the vehicle, a penetrator and/or debris above the mine is propelled upward. If the bottom of the vehicle is flat and parallel to the ground, much of the energy of the mine and any material propelled by it may hit the bottom surface perpendicular to its surface. As a result, the energy of the material and the blast is most efficiently transferred to that surface and the probability that the armor bottom will be defeated and breached is maximized. Additionally, the energy of the material and the blast being transferred to that surface may cause the vehicle itself to be propelled upward, and in some cases, leave the surface on which the vehicle runs.

Traditional theory says that the blast energy of a mine, specifically a shaped mine, is directed upwards from the mine in a conical shape, widening as material is propelled upward. However, when a traditional mine is buried beneath the ground, such as, for example, under sand or soil, the blast usually results in a cylindrical column of sand or soil. This column typically has less than a 5 degree deviation, from vertical, in any direction. This column of sand or soil can be referred to as "soil ejecta." Because the traditional theory relies on the concept of a conical shaped upward blast, conventional mine-protected vehicles have been designed with a relatively higher ground clearance to allow more of the blast energy to dissipate in the space above the ground before encountering the bottom of the vehicle. However, because very little energy actually dissipates from the soil ejecta before it contacts the vehicle, the higher ground clearance has little or no effect. Therefore, a high ground clearance may only serve to raise the center of gravity of the vehicle. This may cause the vehicle to have a higher center of gravity, and may reduce the maneuverability of the vehicle.

If the bottom of the vehicle is not flat, energy and blast material impulses may be less efficiently transferred to the body of the vehicle. One such example of this is U.S. Pat. No. 7,357,062 to Joynt ("the '062 patent"). The '062 patent discloses a mine resistant armored vehicle with a V-shaped bottom portion of the body, and with the angle of the V between about 115 and 130 degrees. While this V-shaped bottom portion may help reduce the transfer of blast energy to the body of the vehicle, further improvements may be made in helping to protect vehicles from ejecta that launch straight upwards.

SUMMARY OF THE INVENTION

In accordance with one aspect, the present disclosure is directed toward a system for protecting a vehicle from a mine, the mine being located at or underneath the surface on which the vehicle is traveling, the mine upon detonation yielding ejecta having an expected vertically upward trajectory, and the vehicle having a hull with an underbody. The system includes a first layer of material disposed outside of the underbody, the first layer of material including a sheet-like base disposed in a direction substantially parallel to the underbody, and a protrusion that narrows in width as it extends away from the sheet-like base in a direction opposing the expected trajectory of the ejecta, the protrusion narrowing to an apex. The system also includes a second layer including a material having a shock wave transmission velocity that is higher than a shock wave transmission velocity of the material of the first layer, the second layer substantially covering the sheet-like base of the first layer. The system further includes an exterior layer substantially covering the first and second layers, the exterior layer having an exterior surface that faces away from the underbody and toward the expected trajectory of the ejecta. The exterior layer extends at an angle, relative to the sheet-like base of the first layer, from the apex of the protrusion of the first layer to at least one portion of the sheet-like base of the first layer that is disposed away from the protrusion.

DETAILED DESCRIPTION OF THE DRAWINGS

Figure 1:
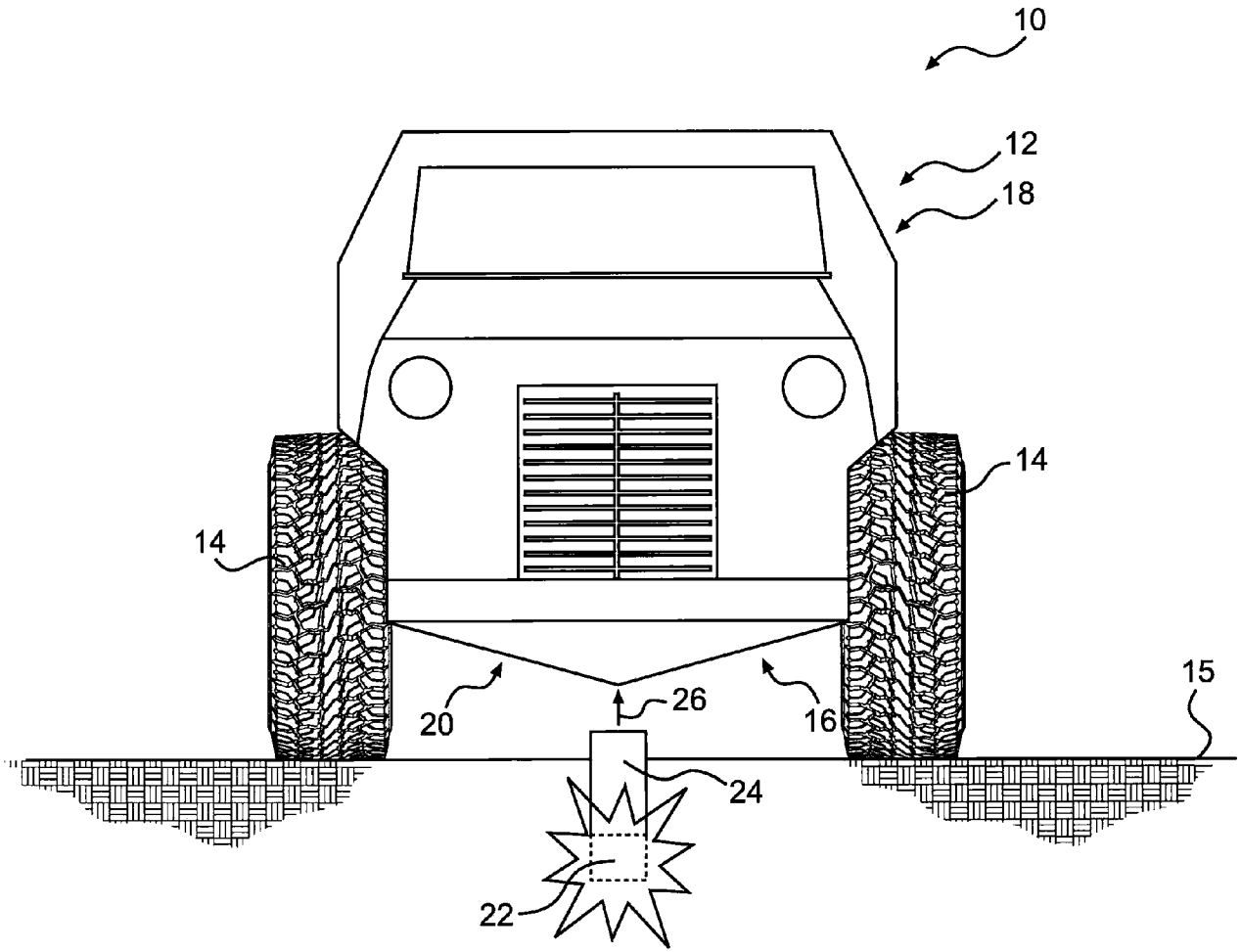
FIG. 1 is an illustration of an exemplary vehicle including a system for protecting the exemplary vehicle from a mine.

FIG. 1 illustrates a vehicle 10 that may be a high performance vehicle such as, for example, a military vehicle. It is also contemplated that vehicle 10 may be any other vehicle such as, for example, a construction vehicle or a commercial vehicle. Vehicle 10 may include a body 12 formed of sheet materials such as, for example, steel plates. Vehicle 10 may also include one or more traction devices 14 for allowing movement of vehicle 10 over a surface 15, and a modular system 16 for protecting vehicle 10 against external threats.

Body 12 may include a hull 18 having one or more interior compartments such as, for example, a passenger compartment. The passenger compartment may be located at or near a central portion of hull 18. Hull 18 may include an underbody 20 disposed at a lower portion of vehicle 10, near surface 15, which may be, for example, a ground surface. Underbody 20 may help to protect passengers and contents located within the compartments of hull 18 from a threat such as, for example, a detonation of a mine 22 that may be located at or underneath surface 15.

As vehicle 10 moves over surface 15 in a vicinity of mine 22, the weight of vehicle 10 may cause mine 22 to detonate, yielding ejecta 24 that may be propelled toward underbody 20 in an expected trajectory 26 that may be substantially vertical. Ejecta 24 may be, for example, cylindrically-shaped ejecta including soil and/or other material that has been broken away from a substrate beneath surface 15 by detonation forces of mine 22.

Figure 2:
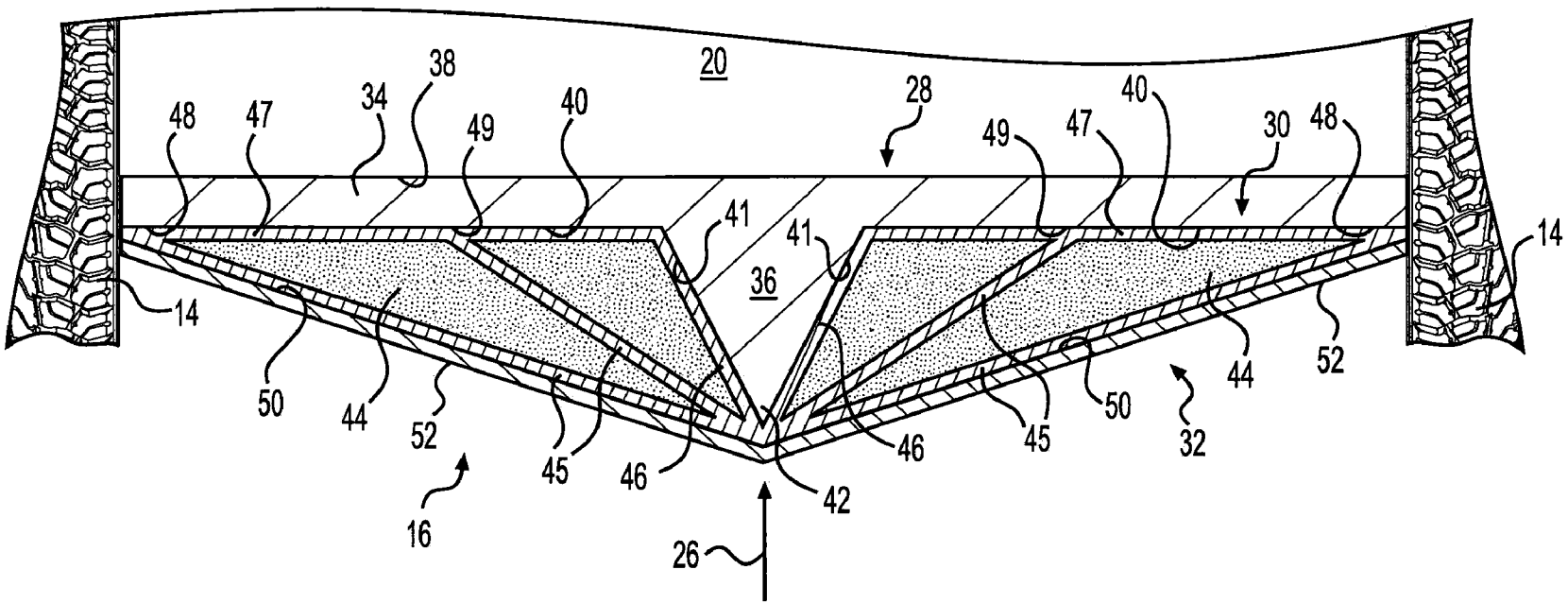
FIG. 2 is a cross-sectional view of a first configuration of the system for protecting the exemplary vehicle of FIG. 1 from a mine.

As shown in FIG. 2, modular system 16 may be a layered member that is disposed outside of underbody 20 of hull 18. Modular system 16 may include a first layer 28, a second layer 30, and an exterior layer 32 that are arranged to help protect vehicle 10 against a threat such as ejecta 24.

First layer 28 may be a solid material that is disposed outside of underbody 20. First layer 28 may include a base 34 and a protrusion 36. First layer 28 may include a material having a very low shock wave transmission velocity and a high temperature resistance. The material of first layer 28 may have a shock wave transmission velocity (expressed in units of meter/second) such as, for example, between about 0 and about 800 m/s, or between about 0 and about 400 m/s. For example, the material of first layer 28 may have a shock wave transmission velocity of between about 10 and 20 m/s. The material of first layer 28 may also have a high temperature resistance. The material of first layer 28 may have a temperature resistance (expressed in units of degrees Celsius) such as, for example, between about 80° and about 500° Celsius, or between about 200° and about 500° Celsius. The material of first layer 28 may include, for example, vermiculite-epoxy-pressed material, diatomaceous earth, soapstone, or any other material having suitable properties such as, for example, material including silica.

Base 34 of first layer 28 may be a sheet-like base material that is disposed in a direction substantially parallel to underbody 20. Base 34 may be disposed along an exterior surface 38 of underbody 20, and may be attached to underbody 20 by any suitable method in the art such as, for example, adhesives and/or mechanical fasteners such as studs that are attached to surface 38 of underbody 20 and extend into first layer 28. Base 34 may have one or more exterior surfaces 40 that may be substantially parallel to exterior surface 38 of underbody 20, and may face in a direction opposing expected trajectory 26.

Protrusion 36 of first layer 28 may be of a similar material and integral with base 34, or may be an element of a similar material as base 34 that is attached to base 34. Protrusion 36 may narrow in width as it extends away from base 34 in a direction opposing expected trajectory 26 of ejecta 24. Protrusion 36 may include a plurality of exterior surfaces 41 that narrow to form an apex 42. Apex 42 may be a triangular point, a rounded shape, a shape with a flattened top, or any other suitable shape. Protrusion 36 may be, for example, a "V"-shaped wedge that extends longitudinally along surface 38 of underbody 20.

Second layer 30 may substantially cover surface 40 of base 34 and surfaces 41 of protrusion 36. Second layer 30 may include one or more portions 44 and/or one or more elements 45, 46, and 47 arranged to help protect vehicle 10 from external threats.

The one or more portions 44 may include a material having a high shock wave transmission velocity. The material of portion 44 may have a shock wave transmission velocity that is higher than a shock wave transmission velocity of the material of first layer 28, and may have a high latent heat of evaporation. The material of portion 44 may have a shock wave transmission velocity (expressed in units of meter/second) such as, for example, between about 1500 and about 2500 m/s, or between about 1600 and about 2000 m/s. The material of portion 44 may also have a high latent heat of evaporation. The material of portion 44 may have a latent heat of evaporation (expressed in units of calories per gram) such as, for example, between about 50 and about 650 calories/gram, or between about 200 and about 600 calories/gram. Portion 44 may include, for example, a liquid or a mixture of liquids having a high shock wave transmission velocity such as gelled or thickened liquids, water, glycerin, and acetic acid. Portions 44 may be disposed between traction devices 14 along a longitudinal direction of vehicle 10, for example, between front and rear traction devices 14.

The one or more elements 45, 46, and 47 may include a material having a very high shock wave transmission velocity. The material of elements 45, 46, and 47 may have a shock wave transmission velocity that is higher than a shock wave transmission velocity of the material of first layer 28. The material of elements 45, 46, and 47 may have a shock wave transmission velocity (expressed in units of meter/second) such as, for example, between about 5,000 and about 10,000 m/s, or between about 6,000 and about 8,000 m/s. For example, elements 45, 46, and 47 may include a solid element having a very high shock wave transmission velocity such as, for example, glass and/or ceramic. The one or more elements 45, 46, and 47 may be a plurality of solid elongated elements that are attached to each other, or a plurality of solid elongated elements that are integrally joined with each other. Elements 45, 46, and 47 may be cylindrical-shaped elements and/or sheet-like elements that extend in a longitudinal direction beneath underbody 20. The one or more elements 45, 46, and 47 may be surrounded on one or more sides by portions 44. As depicted in FIG. 2, elements 45 may extend from a position at or near apex 42 of protrusion 36 to a position at or near respective portions 48 and 49 of surface 40. Respective portions 48 and 49 may be disposed away from protrusion 36. Elements 46 may be disposed along surfaces 41 of protrusion 36. Elements 45 and 46 may be disposed at an angle, relative to surface 40 of base 34. Elements 47 may be disposed substantially parallel to surface 40 of base 34. Elements 45, 46, and 47 may be disposed between traction devices 14 along a longitudinal direction of vehicle 10 (for example, between front and rear traction devices 14) and/or oriented away from traction devices 14.

Exterior layer 32 may include materials such as, for example, metal cladding, and may substantially cover first layer 28 and/or second layer 30. Exterior layer 32 may include an integral sheet-like layer that is angled and/or bent to correspond to a shape of layers 28 and 30, or may include a plurality of sheet-like layers that are attached together via any suitable method such as welding to correspond to the shape of layers 28 and 30. Exterior layer 32 may have an interior surface 50 that faces toward underbody 20 and an exterior surface 52 that faces away from underbody 20 and in a direction opposing trajectory 26 of ejecta 24. Exterior layer 32 may extend at an angle, relative to surface 40 of base 34, from a position at or near apex 42 of protrusion 36 to a position at or near respective portions 48 of surface 40, disposed away from protrusion 36.

Figure 3:
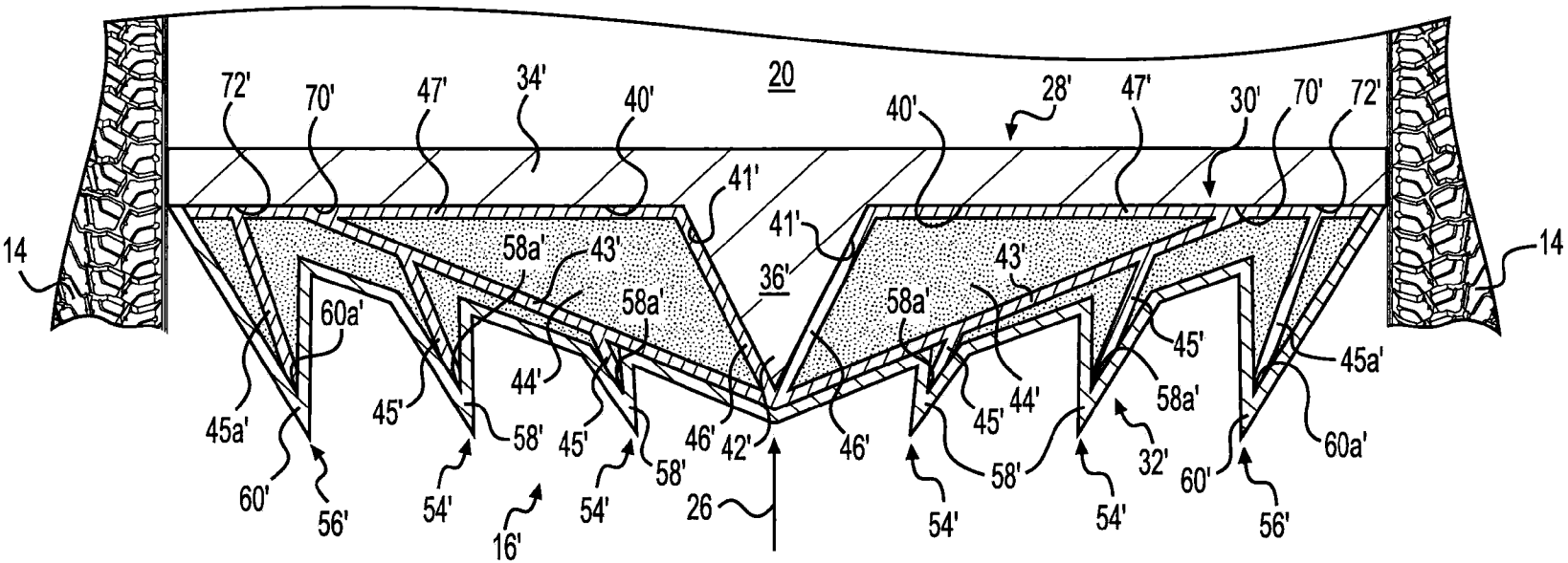
FIG. 3 is a cross-sectional view of a second configuration of the system for protecting the exemplary vehicle of FIG. 1 from a mine.

FIG. 3 depicts another exemplary embodiment of the disclosed modular system for protecting a vehicle. Modular system 16' may include a first layer 28', a second layer 30', and an exterior layer 32'. First layer 28' may include a base 34' and a protrusion 36' that are similar to base 34 and protrusion 36 of first layer 28 of modular system 16, respectively. Base 34' may include one or more surfaces 40', and protrusion 36' may include a plurality of surfaces 41' and an apex 42'.

Exterior layer 32' may be similar to exterior layer 32 of modular system 16, and may additionally include a plurality of exterior protrusions 54' and 56'. Exterior protrusions 54' and 56' may narrow in width as they extend away from underbody 20 in a direction opposing trajectory 26 of ejecta 24. Each exterior protrusion 54' and 56' may narrow to form an apex 58' and 60', respectively. Each apex 58' may have an apex interior 58a', and each apex 60' may have an apex interior 60a'.

Second layer 30' may include one or more portions 44' that may be similar to portions 44 of second layer 30 of modular system 16. Second layer 30' may also include one or more elements 43', 45', 45a', 46', and 47' that may be similar in shape and material to elements 45, 46, and 47 of second layer 30 of modular system 16. As depicted in FIG. 3, elements 43' may extend, at an angle relative to surface 40' of base 34', from a position at or near apex 42' of protrusion 36' to a position at or near a respective portion 70' of surface 40'. Elements 45' may extend from apex interiors 58a' of each apex 58', at an angle relative to surface 40' of base 34', to integrally join or attach to elements 43'. Elements 45a' may extend from apex interiors 60a' of each apex 60', at an angle relative to surface 40' of base 34', to a position at or near a respective portion 72' of surface 40'. Portions 70' and 72' of surface 40' may be disposed away from protrusion 36'. Elements 46' may be disposed along surfaces 41' of protrusion 36'. Elements 47' may be disposed substantially parallel to surface 40' of base 34'. The one or more elements 43', 45', 45a', 46', and 47' may be a plurality of solid elongated elements that are attached to each other, or a plurality of solid elongated elements that are integrally joined with each other.

It is contemplated that an existing vehicle may be retrofitted with a retrofit kit including modular system 16 and/or 16', for increasing the blast-resistance of the existing vehicle against mines and other threats and for gaining other benefits described herein. For example, first layer 28 and/or 28' may be attached to an existing vehicle underbody via adhesives, mechanical connectors, or any other suitable method known in the art. Exterior layer 32 and/or 32' may be attached to an existing body of the vehicle, thereby forming a gap between first layer 28 and/or 28', and exterior layer 32 and/or 32'. For example, a gap may be formed between interior surface 50 of exterior layer 32 and surfaces 40 and 41 of first layer 28. Second layer 30 and/or 30' may be provided in the gap formed between first layer 28 and/or 28', and exterior layer 32 and/or 32'.

The presently-disclosed system may increase the blast-resistance of vehicle 10 or an existing retrofitted vehicle. When vehicle 10 moves over or near mine 22, mine 22 may detonate, propelling ejecta 24 toward underbody 20 in the direction of trajectory 26. Modular system 16 and/or 16' may help to reduce the impact of ejecta 24 on vehicle 10 by dissipating the concentrated forces that may be transferred to vehicle 10 by ejecta 24. For example, ejecta 24 may impact exterior layer 32 of modular system 16, thereby transferring impact forces to first layer 28 and second layer 30 via exterior layer 32. Exterior layer 32 may conduct forces, such as shock wave forces, away from a central part of hull 18 and toward sides of vehicle 10. Because materials of second layer 30 may have a higher shock wave transmission velocity than materials of first layer 28, impact forces from ejecta 24 may be more rapidly transferred to second layer 30 than by first layer 28. Also, because elements 45 and 46 may be angled relative to surfaces 38 of underbody 20 and surface 40 of first layer 28, impact forces may be transferred away from a central part of hull 18, and thereby away from passengers and other contents of vehicle 20, via second layer 30. Protrusion 36 of first layer 28 may geometrically divert additional impact forces away from the central part of hull 18, because of the narrowing shape of protrusion 36 opposing trajectory 26 of ejecta 24. Additionally, because first layer 28 substantially blocks underbody 20 of hull 18 from trajectory 26 of ejecta 24, and because materials of first layer 28 have a lower shock wave transmission velocity than materials of second layer 30 and materials of first layer 28 have a high temperature resistance, the transfer of impact forces and heat from ejecta 24 to hull 18 may be resisted by first layer 28. Additionally, exterior protrusions 54' and 56' may be oriented to transfer impact forces from ejecta 24 away from hull 18. Additionally, elements 45, 46, and 47 may transfer energy from impact forces, and mobilize portion 44 to be directed away from the central part of hull 18 and blow laterally away from the sides of vehicle 10, for example, between front and rear traction devices 14. Portion 44 may thereby carry energy from impact forces away from vehicle 10.

Modular systems 16 and 16' may be used on any vehicle that may benefit from improved blast-resistance from threat devices such as mines. Modular systems 16 and 16' may reduce the effect of impact forces of ejecta 24 on vehicle 10 by dissipating concentrated impact forces, and diverting impact forces away from passengers and other contents of hull 18.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A system for protecting a vehicle from a mine, the mine being located at or underneath the surface on which the vehicle is traveling, the mine upon detonation yielding ejecta having an expected vertically upward trajectory, and the vehicle having a hull with an underbody, the system comprising:

a first layer of material disposed outside of the underbody, the first layer of material including a base disposed in a direction substantially parallel to the underbody, and a protrusion that narrows in width as it extends away from the base in a direction opposing the expected trajectory of the ejecta, the protrusion narrowing to an apex;

a second layer including a material having a shock wave transmission velocity that is higher than a shock wave transmission velocity of the material of the first layer, the second layer covering at least a majority of the base of the first layer; and an exterior layer covering at least a majority of the first and second layers, the exterior layer having an exterior surface that faces away from the underbody and toward the expected trajectory of the ejecta, wherein at least a portion of the exterior layer forms an acute angle relative to the base of the first layer; and a maximum of the width of the protrusion is smaller than a width of the base, the width of the base and the maximum width of the protrusion extending substantially parallel to the underbody.

2. The system of claim 1, wherein the protrusion is a "V"-shaped wedge extending longitudinally along the underbody.

3. The system of claim 1, wherein the first layer is solid.

4. The system of claim 1, wherein:

at least a majority of an interior surface of the exterior layer contacts at least a majority of an exterior surface of the second layer; and at least a majority of an interior surface of the second layer contacts at least a majority of an exterior surface of the first layer.

5. The system of claim 1, wherein:

the exterior layer forms at least one apex;

the second layer forms an apex; and at least a portion of the apex formed by the second layer is located between the apex of the protrusion of the first layer and the at least one apex formed by the exterior layer.

6. The system of claim 1, wherein the second layer material includes a liquid.

7. The system of claim 1, wherein the first layer material includes at least one of vermiculite-epoxy and diatomaceous earth.

8. The system of claim 1, wherein the second layer material includes at least one of water and glycerin.

9. The system of claim 1, wherein the second layer material includes a mixture of one of gelled liquids and thickened liquids.

10. The system of claim 1, wherein the second layer includes a plurality of solid elongated elements.

11. The system of claim 10, wherein the plurality of solid elongated elements extends from the apex of the protrusion of the first layer to portions of the base of the first layer disposed away from the protrusion.

12. The system of claim 11, wherein each solid elongated element is at an angle relative to the base of the first layer.

13. The system of claim 10, wherein the plurality of solid elongated elements include material selected from the group consisting of glass and ceramic.

14. The system of claim 1, wherein the exterior layer includes a plurality of exterior protrusions, each exterior protrusion narrowing in width as it extends away from the underbody in a direction opposing the expected trajectory of the ejecta, each exterior protrusion narrowing to an apex.

15. The system of claim 14, wherein a solid elongated element extends from an apex interior of each exterior protrusion of the exterior layer to a respective portion of the base disposed away from the protrusion.

16. The system of claim 15, wherein each solid elongated element is at an angle relative to the base of the first layer.

17. The system of claim 1, wherein the exterior layer is metal.

18. The system of claim 1, wherein the system is in form of a kit for retrofitting the vehicle.

19. A method for retrofitting an existing vehicle with a blast-resistant kit for protecting the existing vehicle from a mine, the mine being located at or underneath the surface on which the vehicle is traveling, the mine upon detonation yielding ejecta having an expected vertically upward trajectory, and the existing vehicle having a hull with an underbody, the method comprising:

providing a first layer of material outside of the underbody, the first layer of material including a base disposed in a direction substantially parallel to the underbody, and a protrusion that narrows in width as it extends away from the base in a direction opposing the expected trajectory of the ejecta, the protrusion narrowing to an apex, and the base having an exterior surface that faces away from the underbody and toward the expected trajectory of the ejecta, at least a portion of the base forming a sheet, the protrusion forming a wedge attached to a middle portion of the sheet;

providing an exterior layer away from the first layer to form a gap between an exterior surface of the base of the first layer and an interior surface of the exterior layer that faces toward the underbody, wherein at least a portion of the exterior layer forms an acute angle relative to the base of the first layer, and the portion of the exterior layer extends from below the apex of the protrusion of the first layer to below portions of the base of the first layer that are disposed away from the protrusion; and providing a second layer in the gap between the first layer and the exterior layer, the second layer including a material having a shock wave transmission velocity that is higher than a shock wave transmission velocity of the material of the first layer and covering at least a majority of the base of the first layer.

20. The method of claim 19, wherein providing the second layer further includes providing a plurality of solid elongated elements extending from the apex of the protrusion of the first layer to portions of the base of the first layer disposed away from the protrusion.

21. The method of claim 19, wherein providing the exterior layer further includes providing a plurality of exterior protrusions, each exterior protrusion narrowing in width as it extends away in a direction opposing the expected trajectory of the ejecta, each exterior protrusion narrowing to an apex.

22. The method of claim 21, wherein providing the exterior layer further includes providing one or more additional solid elongated elements, each additional solid elongated element extending from an apex interior of each exterior protrusion of the exterior layer to a respective portion of the base, the additional solid elongated elements angled relatively to the base of the first layer.

23. A system for protecting an armored vehicle from a mine, the mine being located at or underneath the surface on which the vehicle is traveling, the mine upon detonation yielding ejecta having an expected vertically upward trajectory, and the vehicle having a hull with an underbody, the system comprising:

a first layer of solid material disposed outside of the underbody, the first layer of solid material including a base disposed in a direction substantially parallel to the underbody, and a protrusion that narrows in width as it extends away from the base in a direction opposing the expected trajectory of the ejecta, the protrusion narrowing to an apex;

a second layer including a liquid mixture having a shock wave transmission velocity that is higher than a shock wave transmission velocity of the solid material of the first layer, the second layer covering at least a majority of the base of the first layer; and an exterior metal layer covering at least a majority of the first and second layers, the exterior metal layer having an exterior surface that faces away from the underbody and toward the expected trajectory of the ejecta, wherein the exterior metal layer extends at an angle, relative to the base of the first layer, from the apex of the protrusion of the first layer to portions of the base of the first layer that are disposed away from the protrusion; and wherein the second layer further includes a plurality of solid elongated elements that extend from the apex of the protrusion of the first layer to portions of the base of the first layer disposed away from the protrusion.

24. The system of claim 23, wherein at least a portion of the base forms a sheet.

* * * * *